US009572442B1

(12) United States Patent
Frost

(10) Patent No.: US 9,572,442 B1
(45) Date of Patent: Feb. 21, 2017

(54) ERGONOMIC COMBINATION UTENSIL SYSTEM

(71) Applicant: Martin L. Frost, Mission Viejo, CA (US)

(72) Inventor: Martin L. Frost, Mission Viejo, CA (US)

( * ) Notice: Subject to any disclaimer, the term of this patent is extended or adjusted under 35 U.S.C. 154(b) by 230 days.

(21) Appl. No.: 14/255,412

(22) Filed: Apr. 17, 2014

Related U.S. Application Data

(60) Provisional application No. 61/815,725, filed on Apr. 24, 2013.

(51) Int. Cl.
*A47J 43/28* (2006.01)
*A47G 21/06* (2006.01)

(52) U.S. Cl.
CPC ..... *A47G 21/06* (2013.01)

(58) Field of Classification Search
CPC ..... A47G 21/02; A47G 21/06; A47G 21/023; A47G 21/00
USPC ..... 30/147
See application file for complete search history.

(56) References Cited

U.S. PATENT DOCUMENTS

| | | | | |
|---|---|---|---|---|
| 33,730 | A | 11/1861 | Ames | |
| 34,069 | A | 1/1862 | Neill | |
| 147,119 | A | 2/1874 | Francis | |
| 278,951 | A | 5/1883 | Hartman | |
| 1,229,696 | A | 5/1917 | Woods | |
| 1,353,090 | A | 9/1920 | Teixeira | |
| 1,488,463 | A | 4/1924 | Abram | |
| 4,984,367 | A * | 1/1991 | Albanese | A47G 21/02 30/147 |
| 7,013,568 | B2 | 3/2006 | Schmidt | |
| D533,034 | S * | 12/2006 | Wasserman | A47G 21/02 D7/653 |
| 8,726,525 | B2 * | 5/2014 | Bagley | A47J 17/02 30/279.2 |
| 2008/0256807 | A1 | 10/2008 | Kirkup | |
| 2012/0011727 | A1 | 1/2012 | Yang | |
| 2012/0324741 | A1 | 12/2012 | Pookrum | |

FOREIGN PATENT DOCUMENTS

| | | | | |
|---|---|---|---|---|
| GB | 2512090 | * | 9/2014 | A47G 21/04 |

* cited by examiner

*Primary Examiner* — Omar Flores Sanchez
(74) *Attorney, Agent, or Firm* — Quickpatents, LLC; Kevin Prince

(57) ABSTRACT

A utensil system for ergonomically cooperating with a person's hand includes a scoop utensil with a forward scoop, a central portion generally triangular shaped in cross-section, and a rear portion. A knife utensil comprises a forward blade and a bulbous grip fixed with the forward blade and adapted for holding in the person's palm. When the knife utensil and the scoop utensil are reversely oriented in a nested configuration, the bulbous grip of the knife utensil fits within the forward scoop of the scoop utensil, and the rear portion of the scoop utensil fits around the forward blade of the knife utensil. A second scoop utensil being a mirror image of the scoop utensil may be fixed with the knife utensil in the nested configuration simultaneously with the scoop utensil. The scoop utensils and knife utensil, when all forwardly aligned and magnetically attached, may assume a presentation configuration.

20 Claims, 7 Drawing Sheets

ERGONOMIC COMBINATION UTENSIL SYSTEM

CROSS-REFERENCE TO RELATED APPLICATIONS

This application claims the benefit of U.S. Provisional Patent Application 61/815,725, filed on Apr. 23, 2013, and incorporated herein by reference.

STATEMENT REGARDING FEDERALLY SPONSORED RESEARCH AND DEVELOPMENT

Not Applicable.

FIELD OF THE INVENTION

This invention relates to utensils, and more particularly to an ergonomic utensil system.

DISCUSSION OF RELATED ART

Numerous eating utensils are known in the art, the most common of which are knife, fork and spoon. In Western cultures, traditional eating utensils commonly utilize a shaft with which to grasp the implement and feature either offset fork/spoon utensils or a linear knife extension. Typically, and for good commercial reasons, these utensils are "non-handed," that is, equally usable by those who are either left or right-handed. Common also to these devices is a long, slim overall format.

Numerous forms of multi-purpose eating utensils exist, often in the form of pen-knife type multi-tools for camping and recreation. These types of prior art devices feature fold-out functions for knife, fork and spoon.

Another variation on the multi-purpose format is the so-called "spork" featuring a combination of a spoon and fork at one end, a fork and knife at one end, or other combinations thereof. A pair of sporks is required in order to effectively cut and fork food simultaneously. For instance, U.S. Pat. Application No. 2009/0172949 to Watts on Jul. 9, 2009 references such a format. The invention is an easy-to-use double-sided eating utensil. This type of product features a spoon on one end facing up and a fork at the other end faced down. As such a flip backwards of the utensil is all that is required to use either function. Various other prior art devices exist duplicating this type of format.

U.S. Pat. No. 4,317,284 to Prindle on Mar. 2, 1982 discloses conventionally-designed Western eating utensils, namely knife, fork and spoon magnetically attached, in which the fork and tines correspond to the curvature of the spoon bowl. The major faces of the knife blade are perpendicular to the knife handle and the knife blade extends between the fork tines toward the longitudinal centerline of the spoon bowl.

U.S. Pat. Application No. 2011/0035946 to Menceles on Feb. 17, 2011 discloses a combination eating utensil arranged as removable halves, one side with a fork at one end and a blade at the other. The other side includes a bowl scoop at one end, each removably attached to one another via a groove and lip interlocking mechanism.

U.S. Pat. No. 6,276,734 to Kreiger on Aug. 21, 2001 discloses an eating utensil comprising a counterbalanced handle at one end with integral extended tong members for gripping of food items.

U.S. Pat. No. 7,784,188 to Yackshaw on Aug. 31, 2010 discloses a one-hand eating utensil apparatus comprising both knife and fork, each bent at 90-degrees in the same direction from the handle grip, permanently and pivotally connected at the ends of tongs. The apparatus provides a spring return to an open position.

U.S. Pat. No. 7,628,432 to Flather on Dec. 8, 2009 discloses a multi-purpose eating utensil in the form of integrated one-piece tongs with two projecting arms, the ends of which are biased apart. Such a device is shaped to offer the utility of chopsticks, fork, spoon (if the ends are squeezed together) or knife.

In respect of ergonomic grips, U.S. Pat. Application No. 2008/0134519 to Lawlor et al. on Jun. 12, 2008 discloses an eating utensil that allows an ergonomic grip thereof via an extended loop of varying thickness that enables users of differing hand sizes to secure a grip on the utensil at various angels to reach foods in a variety of types of serving dishes.

U.S. Pat. No. 4,035,865 to McRae et al. on Jul. 19, 1977 discloses implements useable by persons afflicted with arthritis. In this case, implements are equipped with spherical handles that can be easily grasped by persons afflicted with arthritis. Such a spherical handle has a diameter that permits the sphere to be retained against the person's palm between the thumb and a finger without bending internal joints.

U.S. Pat. Application No. 2008/0256807 to Kirkup on Oct. 23, 2008 discloses an ergonomic training utensil for teaching a user to self-feed. This type of product includes a handle and at least one food accommodating means extending from at least one end of the handle. Ergonomic utility is provided by a bulbous cross section of the handle.

U.S. Pat. Application No. 2012/0167348 to Adams on Jul. 5, 2012 discloses an apparatus for gripping household items and a method for using same. Such a product comprises a spherical handle penetrated by a bore and bordered by two flanges through which utensils are inserted and thus mutually secured. The spherical handle permits a more complete grip to the utensil thereby facilitating easier operation.

Therefore, there is a need for a utensil device that allows several utensils to be stored together in an aesthetic manner that also provides utensils that fit better with the hand, whether the user is right or left-handed. Such a needed invention would provide both a nested, collapsed storage configuration and a displayable presentation configuration. The collapsed storage configuration would shield users from sharp edges and points of the fork tines and knife blades to reduce the chance of injury. Such a needed device would be relatively inexpensive to manufacture, dishwasher safe, and easy to use. The present invention accomplishes these objectives.

SUMMARY OF THE INVENTION

The present device is a utensil system for ergonomically cooperating with a person's hand. The utensil system comprises a scoop utensil that comprises a forward scoop having a forward edge, a bottom edge, a top edge, a concave inner side, and a convex outer side. The forward edge of the forward scoop may include a plurality of tines, a sharpened edge and/or a serrated edge. The scoop utensil further includes a central portion having a generally concave inner side and a generally convex outer side. The outer side includes a top recess and a bottom recess, each recess, adapted for receiving a finger of the person's hand for gripping and controlling the scoop utensil. The inner side is adapted for receiving a thumb of the person's hand proximate a longitudinal centerline thereof for gripping and controlling the scoop utensil. The central portion forms control surfaces generally triangular shaped in cross-section for adapting to the shape formed between the thumb and two fingers when gripping the central portion. The scoop utensil may further include a rear portion that has a curved rear end adapted for contacting the palm of the hand and the pinky finger and ring finger when the utensil is gripped by the person's hand.

The utensil system preferably further includes a knife utensil that comprises a forward blade that has a forward edge, a bottom edge, and a top edge. The knife utensil further includes a bulbous grip fixed with the forward blade and adapted for holding in the person's palm. The bottom edge of the blade is sharpened, and the top edge of the blade has at least one flat area adapted for receiving pressure from the person's index finger. As such, the person holding the knife utensil may apply downward pressure of the sharpened bottom edge of the blade for cutting by pressing down on the flat area. A bottom side of the bulbous grip is substantially flat for support the bulbous grip on a flat surface.

In one preferred embodiment, when the knife utensil and the scoop utensil are reversely oriented in a nested configuration, the bulbous grip of the knife utensil is adapted to fit within the forward scoop of the scoop utensil, and the rear portion of the scoop utensil is adapted to fit around the forward blade of the knife utensil.

The central portion of the scoop utensil may include a thumb recess on the convex outer side adapted for receiving a portion of the person's thumb for controlling the utensil. Such a thumb recess protruding from the concave inner side and is adapted for fitting into an alignment recess of the blade of the knife utensil when in the nested configuration. Such an alignment recess may be an alignment aperture traversing the blade of the knife utensil.

The bulbous grip may include at least one magnet, such that in embodiments wherein the scoop utensil is made at least partially with a magnetically-attractive material, the at least one magnet holds the scoop utensil to the knife utensil when in the nested configuration. Additionally, in one embodiment, the at least one magnet holds the scoop utensil to the knife utensil at the protruding thumb recess when the utensils, are both aligned in a forward direction in a presentation configuration.

In one embodiment, the utensils are made of a non-magnetically-attractive material with at least one magnet in the thumb grip of the scoop utensil. As such, in the nested configuration, the assembly of the utensils and bulbous grip are held together by the magnets in each scoop utensil attracting each other through the alignment aperture in the blade of the knife utensil, each scoop utensil having at least one magnet having an opposing polarity to the at least one magnet in the other scoop utensil. In the presentation configuration, the scoop utensils are both aligned in a forward direction and held to the knife utensil by the magnets and a magnetically-attractive material fixed within the bulbous grip.

In one embodiment, the utensil system includes a second scoop utensil that is a mirror image of the scoop utensil. As such, both scoop utensils, may be fixed with the knife utensil in the nested configuration simultaneously with the rear portion of each scoop utensil covering the blade of the knife utensil. In such an embodiment, the at least one magnet is at least two magnets, such that each of the at least two magnets magnetically holds one of the scoop utensils to the knife utensil when in the nested configuration.

Further, each magnet holds one of the scoop utensils to the knife utensil at the protruding thumb recess when the utensils are all aligned in a forward direction in the presentation configuration.

The present invention is a utensil device that allows several utensils to be stored together in an aesthetic manner that also provides utensils that fit better with the hand, whether the user is right or left-handed. The present device allows for both a nested, collapsed storage configuration and a displayable presentation configuration. The collapsed storage configuration shields users from sharp edges and points of the fork tines and knife blades to reduce the chance of injury. The present invention is further relatively inexpensive to manufacture, dishwasher safe, and easy to use. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Figure 1:
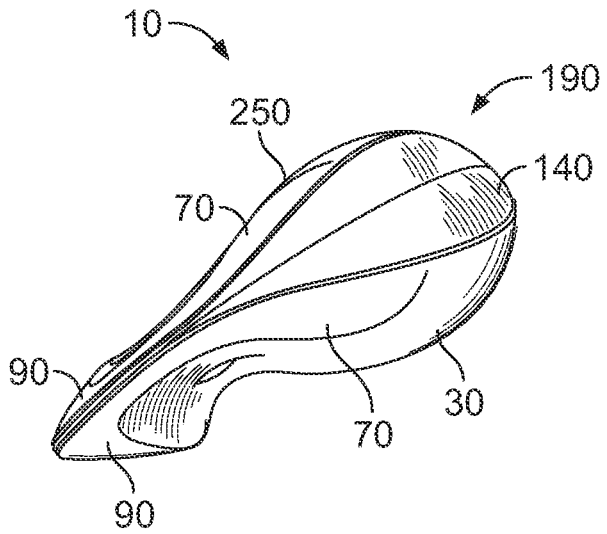
FIG. 1 is a perspective view of one embodiment of the invention illustrated in a nested configuration.
Figure 2:
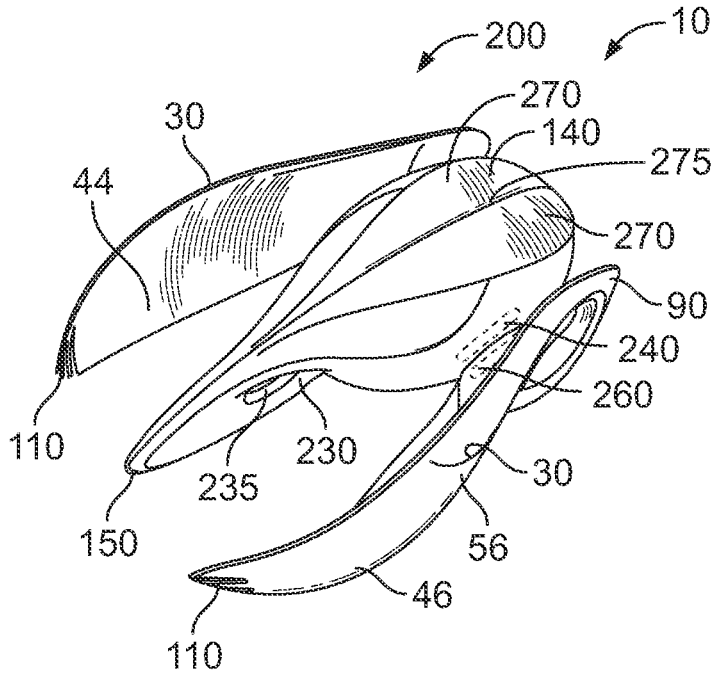
FIG. 2 is a perspective view of the embodiment of FIG. 1 illustrated in a presentation configuration.
Figure 5:
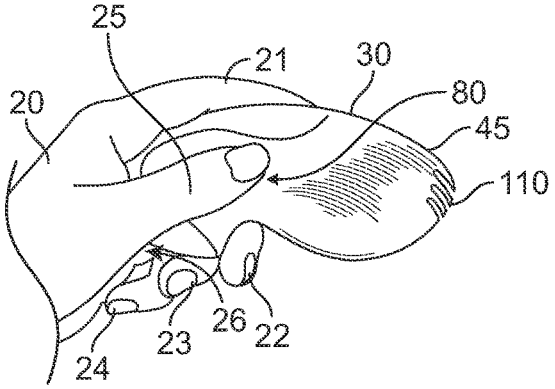
FIG. 5 is a perspective view of a person holding the scoop utensil.

FIGS. 1 and 2 illustrate a utensil system 10 for ergonomically cooperating with a person's hand 20 (FIG. 5). The utensil system 10 comprises a scoop utensil 30 that comprises a forward scoop 40 having a forward edge 45, a bottom edge 42, a top edge 48, a concave inner side 44, and a convex outer side 46.

Figure 3:
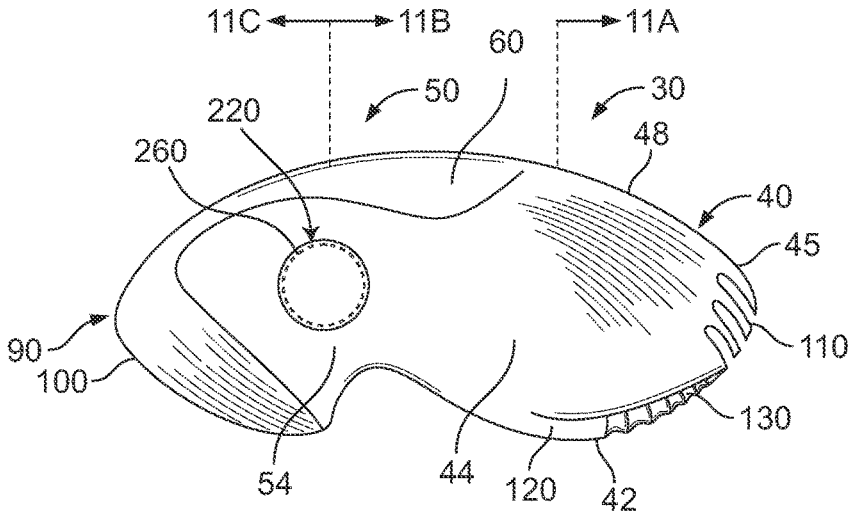
FIG. 3 is a side elevational view of a scoop utensil of the invention.
Figure 11A:
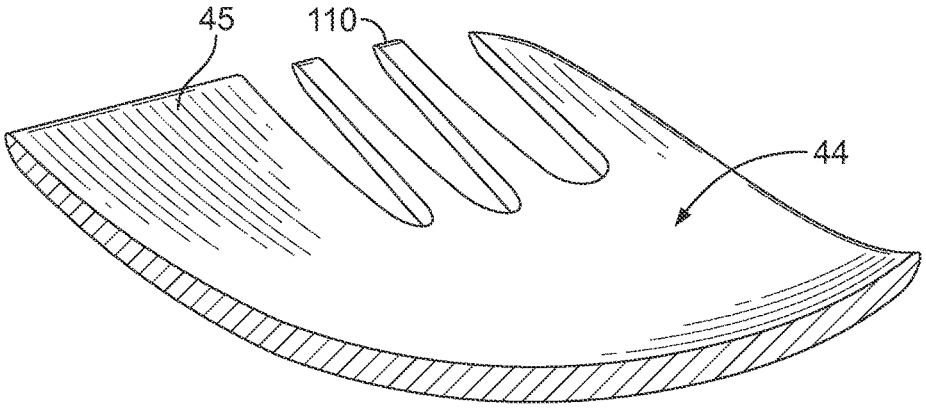
FIG. 11A is a cross-sectional view of the scoop utensil, taken along line 11A-11A of FIG. 3.

In one embodiment, the forward edge 45 of the forward scoop 40 includes a plurality of tines 110 (FIGS. 3 and 11A). Further, the bottom edge 42 of the forward scoop 40 may include a sharpened edge 120 and/or a serrated edge 130.

The scoop utensil 30 further includes a central portion 50 having a generally concave inner side 54 and a generally convex outer side 56. The outer side 56 includes a top recess 60 and a bottom recess 70, each recess 60,70 adapted for receiving a finger 21 of the person's hand 20 for gripping and controlling the scoop utensil 30.

Figure 11B:
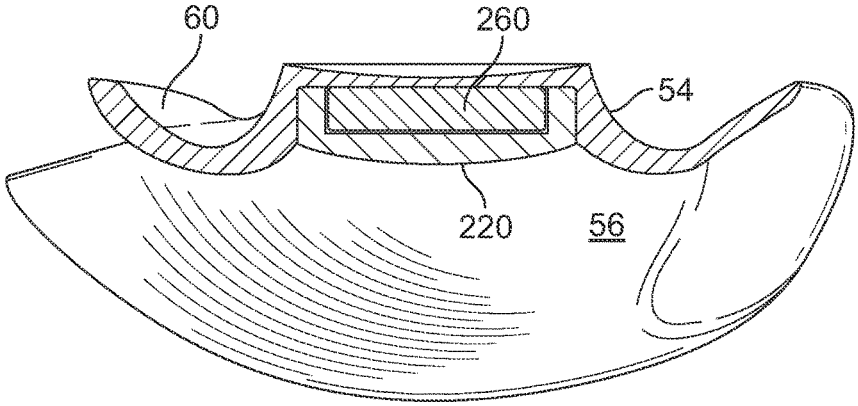
FIG. 11B is a cross-sectional view of the scoop utensil, taken along line 11B-11B of FIG. 3.
Figure 11C:
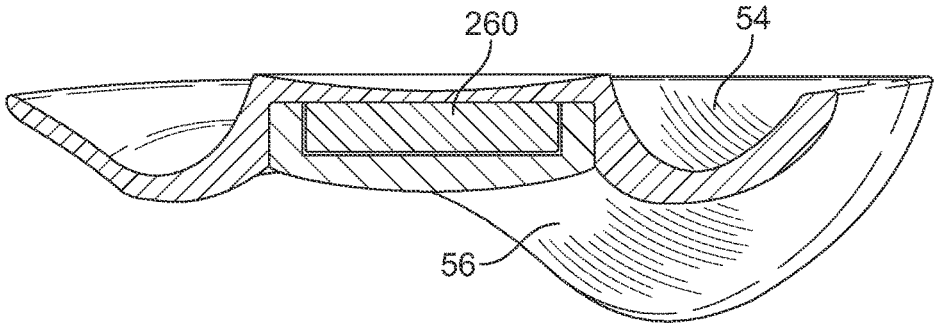
FIG. 11C is a cross-sectional view of the scoop utensil, taken along line 11C-11C of FIG. 3.

The inner side 54 is adapted for receiving a thumb 25 of the person's hand 20 proximate a longitudinal centerline thereof for gripping and controlling the scoop utensil 30 (FIGS. 3, 11B and 11C). The central portion 50 forms control surfaces 80 generally triangular shaped in cross-section for adapting to the shape formed between the thumb 25 and two fingers 21 when gripping the central portion 50.

The scoop utensil 30 may further include a rear portion 90 that has a curved rear end 100 adapted for contacting the palm 26 of the hand 20 and the pinky finger 24 and ring finger 23 when the utensil 30 is gripped by the person's hand 20 (FIGS. 3 and 5). As such, the person's hand 20 may further manually control the utensil 30.

Figure 4:
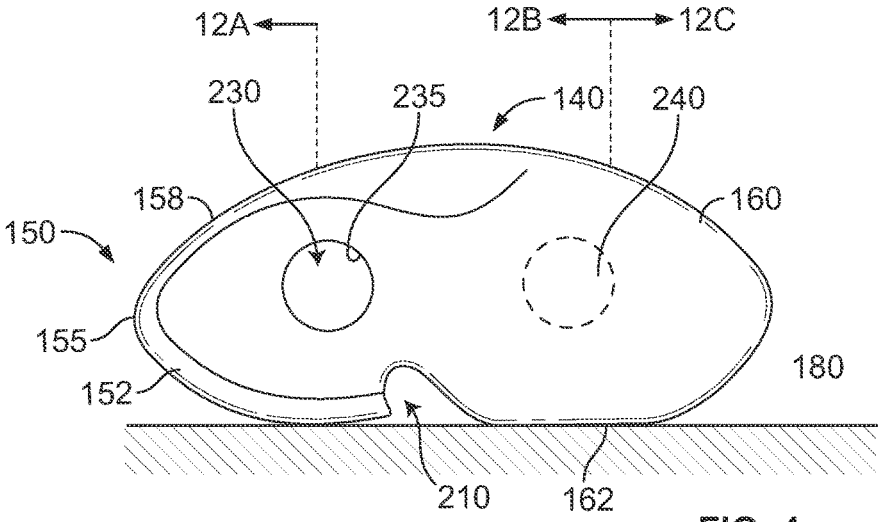
FIG. 4 is a side elevational view of a knife utensil of the invention, illustrated resting on a flat surface.
Figure 6:
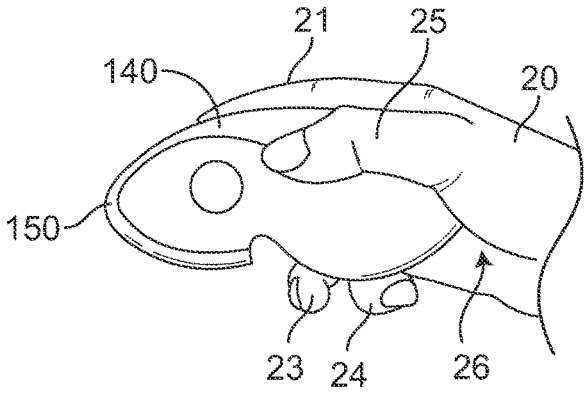
FIG. 6 is a perspective view of a person holding the knife utensil.

The utensil system 10 preferably further includes a knife utensil 140 (FIGS. 2, 4 and 6) that comprises a forward blade 150 that has a forward edge 155, a bottom edge 152, and a top edge 158. The knife utensil 140 further includes a bulbous grip 160 fixed with the forward blade 150 and adapted for holding in the person's palm 26. The bottom edge 152 of the blade 150 is sharpened, and the top edge 58 of the blade 150 has at least one flat area 170 adapted for receiving pressure from the person's index finger 21. As such, the person holding the knife utensil 140 may apply downward pressure of the sharpened bottom edge 152 of the blade 150 for cutting by pressing down on the flat area 170. Such a bottom edge 152 may also be serrated (not shown). A bottom side 62 of the bulbous grip 160 is substantially flat for support the bulbous grip 160 on a flat surface 180 (FIG. 4), such as a table or plate.

In one preferred embodiment, when the knife utensil 140 and the scoop utensil 30 are reversely oriented in a nested configuration 190, the bulbous grip 160 of the knife utensil portion 90 of the scoop utensil 30 is adapted to fit around the forward blade 150 of the knife utensil 140. The knife utensil 140 and the scoop utensil 30 may include an attachment mechanism, such as at least one magnet 240 to hold the utensil system 10 in either the nested configuration 190 or a presentation configuration 200 (FIG. 2), described further below.

Figure 12A:
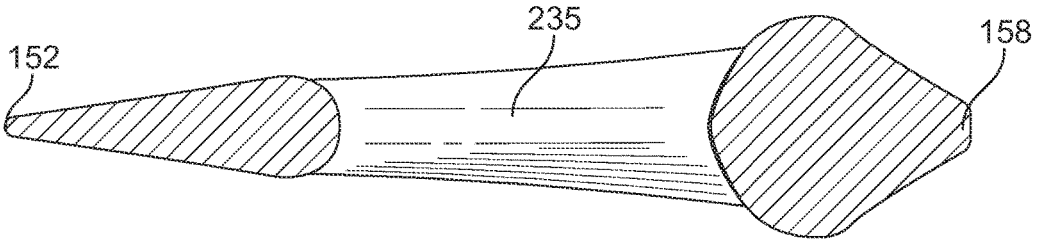
FIG. 12A is a cross-sectional view of the scoop utensil, taken along line 12A-12A of FIG. 4.

The central portion 50 of the scoop utensil 30 may include a thumb recess 220 on the convex outer side 46 adapted for receiving a portion of the person's thumb 25 for controlling the utensil 30. Such a thumb recess 220 protruding from the concave inner side 44 and is adapted for fitting into an alignment recess 230 of the blade 150 of the knife utensil 140 when in the nested configuration 190. Such an alignment recess 230 may be an alignment aperture 235 (FIG. 12A) traversing the blade 150 of the knife utensil 140.

Figure 12B:
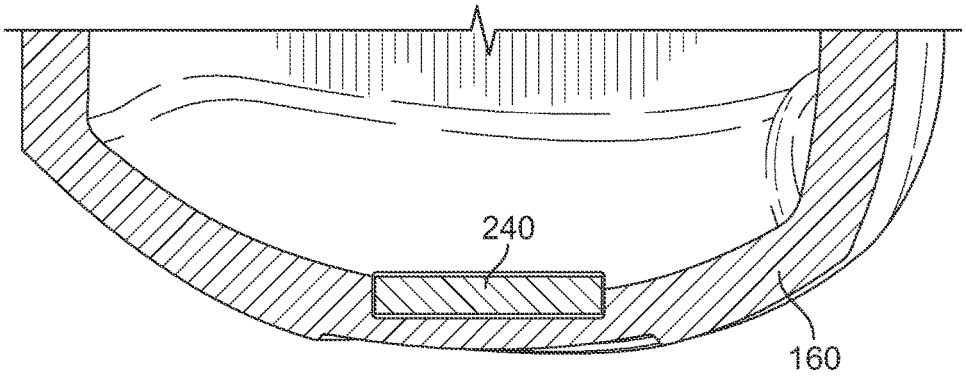
FIG. 12B is a cross-sectional view of the scoop utensil, taken along line 12B-12B of FIG. 4.
Figure 12C:
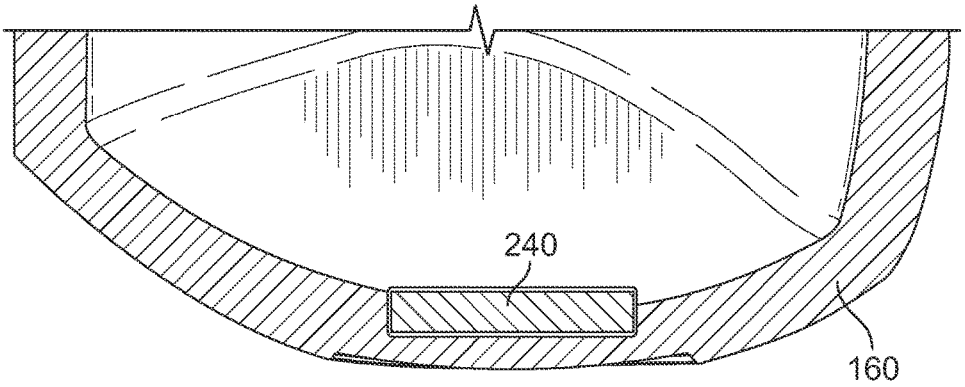
FIG. 12C is a cross-sectional view of the scoop utensil, taken along line 12C-12C of FIG. 4.

The bulbous grip 160 may include at least one magnet 240 (FIGS. 12B and 12C), such that in embodiments wherein the scoop utensil 30 is made at least partially with a magnetically-attractive material, such as certain metals, the at least one magnet 240 holds the scoop utensil 30 to the knife utensil 140 when in the nested configuration 190. Additionally, in one embodiment, the at least one magnet 240 holds the scoop utensil 30 to the knife utensil 140 at the protruding thumb recess 220 when the utensils 30,140 are both aligned in a forward direction in the presentation configuration 200 (FIG. 2).

In one embodiment, the utensil system 10 includes a second scoop utensil 250 that is a mirror image of the scoop utensil 30. As such, both scoop utensils 30,250 may be fixed with the knife utensil 140 in the nested configuration 190 simultaneously (FIG. 1), the rear portion 90 of each scoop utensil 30,250 covering the blade 150 of the knife utensil 140. In such an embodiment, the at least one magnet 240 is at least two magnets 240, such that each of the at least two magnets 240 magnetically holds one of the scoop utensils 30,250 to the knife utensil 140 when in the nested configuration 190. Further, each magnet 240 holds one of the scoop utensils 30,250 to the knife utensil 140 at the protruding thumb recess 220 when the utensils 30,250 are all aligned in a forward direction in the presentation configuration 200 (FIG. 2).

In an alternate embodiment, the bulbous grip 160 includes at least one magnet 240 and the scoop utensil 30,250 includes at least one cooperative magnet 260. As such, the magnets 240,260 hold the scoop utensils 30,250 to the knife utensil 140 when in the nested configuration 190 or the presentation configuration 200. In such an embodiment, the utensils 30,140,250 may all be made from a non-magnetic rigid material such as plastic or aluminum.

In an alternate magnetic embodiment, the scoop utensil 30,250 are made of a non-magnetically-attractive material with at least one magnet 240 in the thumb recess 220 thereof. As such, in the nested configuration 190, the assembly of the utensils 30,250 and the knife utensil 140 are held together by the magnets 240 in each scoop utensil 30,250 attracting each other through the alignment aperture 225 in the blade 150 of the knife utensil 140, each scoop utensil 30,250 having at least one magnet 240 having an opposing polarity to the at least one magnet 240 in the other scoop utensil 250,30. In the presentation configuration, the scoop utensils 30,250 are both aligned in a forward direction and held to the knife utensil 140 by the magnets 240 and a magnetically-attractive material (not shown) fixed within the bulbous grip 160.

Figure 7:
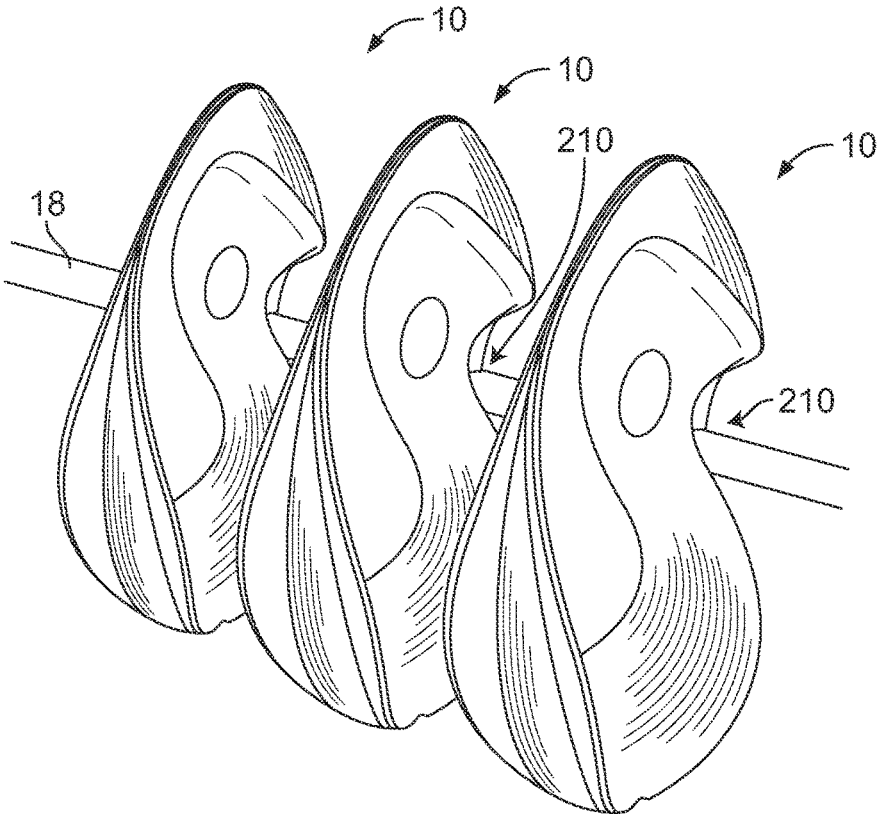
FIG. 7 is a perspective view of a plurality of the present inventions illustrated as stored on a storage rod.
Figure 8:
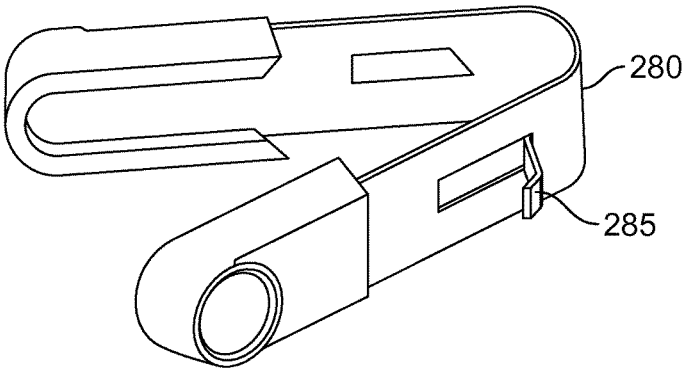
FIG. 8 is a perspective view of a spring clip of the invention.

In one embodiment, the bottom edge 152 of the forward blade 150 terminates at the bulbous grip 160 in a hook 210, such that the scoop utensil 30 and knife utensil 140 when in the nested configuration 190 may be suspended from a horizontal bar 18 or dowel for storage (FIG. 7). Further, the knife utensil 140 may be comprised of two symmetric halves 270 each permanently joined along a centerline 275 thereof such as by an adhesive (not shown), mechanical fasteners (not shown), ultrasonic welding, or the like.

Figure 9A:
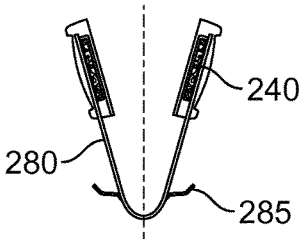
FIG. 9A is a top plan view of the spring clip.
Figure 9B:
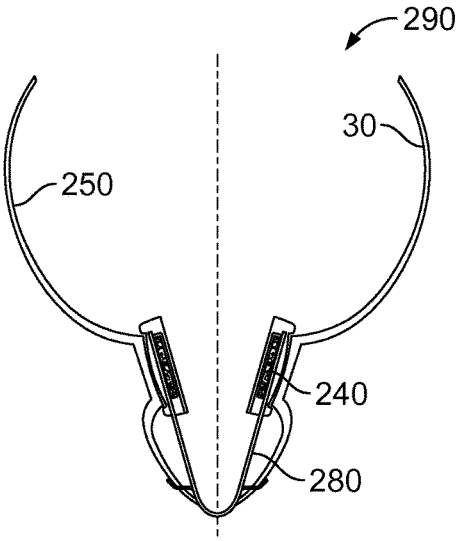
FIG. 9B is a top plan view of the spring clip as attached to two scoop utensils to create an open tongs configuration.
Figure 9C:
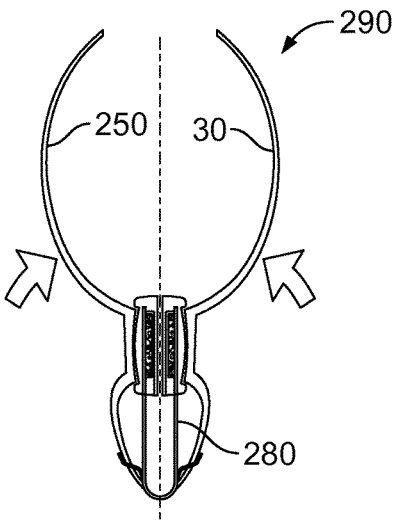
FIG. 9C is a top plan view of the scoop utensils and spring clip in a closed tongs configuration.
Figure 10:
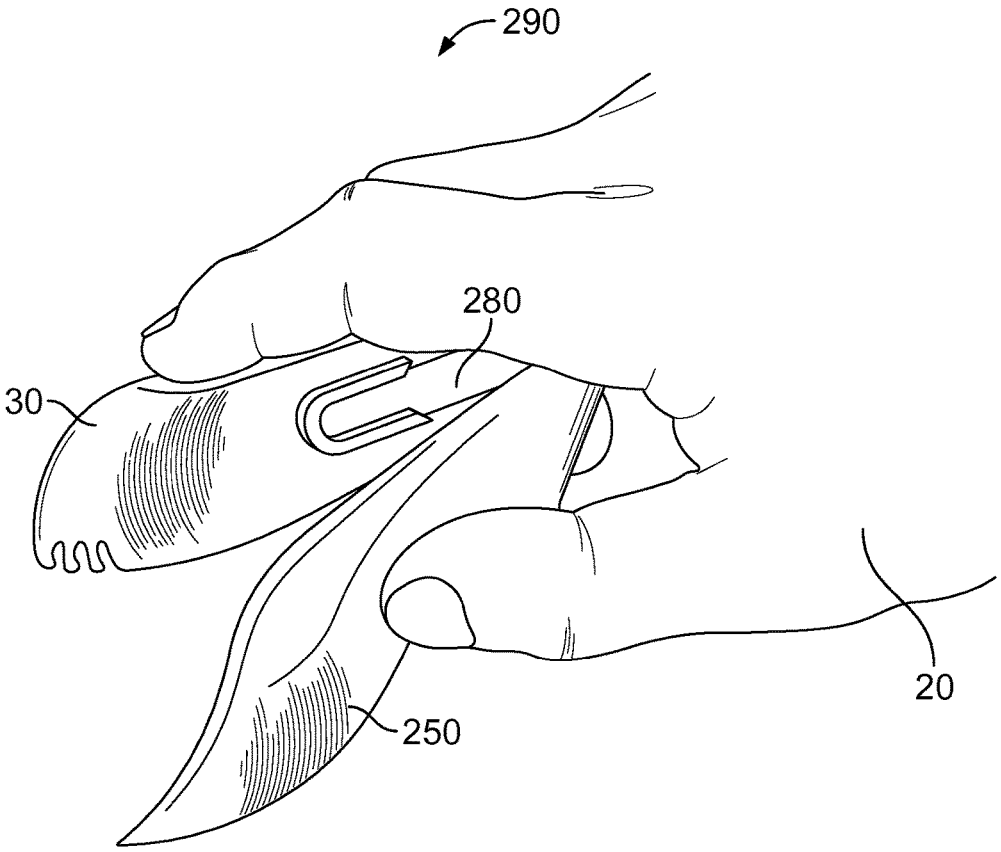
FIG. 10 is a perspective view of the spring clip and two scoop utensils in the tongs configuration shown as in-use by a person.

In one embodiment, the utensil system 10 further includes a spring clip 280 (FIGS. 9A-9C) attachable to the rear portion 90 of each scoop utensil 30,250 such that the scoop utensils 30,250 face each other and are biased apart, whereby a user may use the combination of the two scoop utensils 30,250 and spring clip 280 in a tongs configuration 290 (FIG. 10). The spring clip 280 may include at least one of the magnets 240 for magnetically fixing each scoop utensil 30,250 thereto. Further, the spring clip 280 may include a pair of hooks 285 for fixing around each utensil 30,250 or through apertures (not shown) in each utensil 30,250 for further securing the spring clip 280 to each utensil 30,250. In embodiments wherein each utensil 30,250 includes one of the magnets 240, the spring clip 280 may be made at least partially with a magnetically-attractive material whereby the magnets 240 in the utensils 30,250 hold the utensils 30,250 to the spring clip 280 (not shown).

While the preferred mode of attaching each utensil 30,250 to the knife utensil 140 is with at least one magnet 240, other mechanical fastening mechanisms could also be used, such as a mechanical "twist-lock" fastening mechanism (not shown), or a friction-fit tab and slot arrangement (not shown), or the like.

While a particular form of the invention has been illustrated and described, it will be apparent that various modifications can be made without departing from the spirit and scope of the invention. For example, the particular shape illustrated in the figures showing the utensils 30,140,250 are for illustrative purposes only and show one possible shape embodiment. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A utensil system for ergonomically cooperating with a person's hand, comprising a scoop utensil that comprises a forward scoop having a forward edge, a bottom edge, a top edge, a concave inner side, and an convex outer side; and a central portion having a generally concave inner side and a generally convex outer side, the outer side including a top recess and a bottom recess, each recess adapted for receiving a finger of the person's hand for gripping and controlling, the inner side adapted for receiving a thumb of the person's hand proximate a longitudinal centerline thereof for gripping and controlling, the central portion forming control surfaces generally triangular shaped in cross-section for adapting to the shape formed between the thumb and two fingers when gripping the rear portion, the scoop utensil further including a rear portion having a curved rear end adapted for contacting the palm of the hand and the pinky and ring fingers when the utensil is gripped by the person, whereby the person may further manually control the utensil.

2. The utensil system of claim 1 wherein the forward edge of the forward scoop of the scoop utensil includes a plurality of tines.

3. The utensil system of claim 1 wherein the bottom edge of the forward scoop of the scoop utensil include a sharpened edge.

4. The utensil system of claim 1 wherein the bottom edge of the forward scoop of the scoop utensil include a serrated edge.

5. The utensil system of claim 1 further including a knife utensil comprising a forward blade having a forward edge, a bottom edge, and a top edge; and a bulbous grip fixed with the forward blade and adapted for holding in the person's palm, the bottom edge of the blade being sharpened, the top edge of the blade having at least one flat area adapted for receiving pressure from the person's index finger, a bottom side of the bulbous grip being substantially flat for supporting the bulbous grip on a flat surface, whereby the person holding the knife utensil may apply downward pressure of the sharpened blade for cutting.

6. The utensil system of claim 5 wherein the sharpened bottom edge of the knife utensil is serrated.

7. The utensil system of claim 5 wherein the bulbous grip of the knife utensil is adapted to fit within the forward scoop of the scoop utensil, and wherein the rear portion of the scoop utensil is adapted to fit around the forward blade of the knife utensil, when the knife utensil and the scoop utensil are reversely oriented in a nested configuration.

8. The utensil system of claim 7 wherein the bottom edge of the forward blade terminates at the bulbous grip at a hook, whereby the scoop and knife utensils when in the nested configuration may be suspended from a horizontal bar for storage.

9. The utensil system of claim 7 wherein central portion of the scoop utensil includes a thumb recess on the convex outer side, the thumb recess protruding from the concave inner side and adapted for fitting into an alignment recess of the blade of the knife utensil when in the nested configuration.

10. The utensil system of claim 9 wherein the alignment recess is an alignment aperture traversing the blade of the knife utensil.

11. The utensil system of claim 7 wherein the bulbous grip includes at least one magnet and wherein the scoop utensil is made at least partially with a magnetically-attractive material, whereby the magnet holds the scoop utensil to the knife utensil when in the nested configuration.

12. The utensil system of claim 9 wherein the bulbous grip includes at least one magnet and wherein the scoop utensil is made at least partially with a magnetically-attractive material, whereby the magnet holds the scoop utensil to the knife utensil when in the nested configuration, and wherein the magnet holds the scoop utensil to the knife utensil at the protruding thumb recess when the utensils are both aligned in a forward direction in a presentation configuration.

13. The utensil system of claim 7 further including a second, reversed scoop utensil that is a mirror image of the scoop utensil, whereby both scoop utensils may be fixed with the knife utensil in the nested configuration simultaneously, the rear portion of each scoop utensil substantially covering the blade of the knife utensil.

14. The utensil system of claim 12 further including a second, reversed scoop utensil that is a mirror image of the scoop utensil and wherein the at least one magnet is at least two magnets, whereby each of the at least two magnets magnet holds one of the scoop utensils to the knife utensil when in the nested configuration, and wherein each magnet holds one of the scoop utensil to the knife utensil at the protruding thumb recess when the utensils are all aligned in a forward direction in a presentation configuration.

15. The utensil system of claim 7 wherein the bulbous grip includes at least one magnet and wherein the scoop utensil includes at least one cooperative magnet, whereby the magnets holds the scoop utensil to the knife utensil when in the nested configuration.

16. The utensil system of claim 9 wherein the bulbous grip includes at least one magnet and wherein the scoop utensil includes at least two cooperative magnets, whereby the magnets hold the scoop utensil to the knife utensil when in the nested configuration, and wherein the magnets hold the scoop utensil to the knife utensil at the protruding thumb recess when the utensils are both aligned in a forward direction in a presentation configuration.

17. The utensil system of claim 15 further including a second, reversed scoop utensil that is a mirror image of the scoop utensil and wherein the at least one magnet of the knife utensil is at least two magnets, and wherein the at least one cooperative magnet of each scoop utensil is at least two cooperative magnets, whereby each of the at least two magnets of the knife utensil hold one of the scoop utensils to the knife utensil at one of the cooperative magnets thereof when in the nested configuration, and wherein each magnet of the knife utensil holds one of the scoop utensils to the knife utensil at the protruding thumb recess thereof with the other of the at least two cooperative magnets when the utensils are all aligned in a forward direction in a presentation configuration.

18. The utensil system of claim 5 wherein the knife utensil is comprised of two symmetric halves each permanently joined along a centerline thereof.

19. The utensil system of claim 13 further including a spring clip attachable to the rear portion of each scoop utensil such that the scoop utensils face each other and are biased apart, whereby a user may use the combination of the two scoop utensils and spring clip in a tongs configuration.

20. The utensil system of claim 7 wherein the bulbous grip is made at least partially from a magnetically-attractive material and wherein the scoop utensil includes at least one magnet, whereby the magnet holds the scoop utensil to the knife utensil when in the nested configuration.

* * * * *